US009370820B2

(12) United States Patent
Seewraj et al.

(10) Patent No.: US 9,370,820 B2
(45) Date of Patent: Jun. 21, 2016

(54) FASTENER INSTALLATION TOOL

(71) Applicant: AVDEL UK LIMITED, Hertfordshire (GB)

(72) Inventors: Angraj Kumar Seewraj, Hertfordshire (GB); Peter Michael Beecherl, Algonac, MI (US)

(73) Assignee: AVDEL UK LIMITED (GB)

( * ) Notice: Subject to any disclaimer, the term of this patent is extended or adjusted under 35 U.S.C. 154(b) by 575 days.

(21) Appl. No.: 13/737,993

(22) Filed: Jan. 10, 2013

(65) Prior Publication Data

US 2013/0117981 A1 May 16, 2013

Related U.S. Application Data

(63) Continuation-in-part of application No. 12/305,423, filed as application No. PCT/GB2008/000276 on Jan. 28, 2008, now abandoned.

(30) Foreign Application Priority Data

Mar. 16, 2007 (GB) ..... 0705144.4

(51) Int. Cl.
*B21J 15/02* (2006.01)
*B21J 15/10* (2006.01)
(Continued)

(52) U.S. Cl.
CPC ..... *B21J 15/22* (2013.01); *B21J 15/043* (2013.01); *B21J 15/105* (2013.01); *B21J 15/326* (2013.01); *Y10T 29/53748* (2015.01)

(58) Field of Classification Search
CPC ..... B21J 15/022; B21J 15/22; B21J 15/043; B21J 15/105; B21J 15/28; B21J 15/34; B21J 15/205; B25B 27/0014
See application file for complete search history.

(56) References Cited

U.S. PATENT DOCUMENTS 4,735,048 A 4/1988 Gregory
5,490,311 A 2/1996 Rosier
(Continued)

FOREIGN PATENT DOCUMENTS

GB 2 192 235 A 1/1988
GB 2192235 1/1988
(Continued)

OTHER PUBLICATIONS

Search Report from the Intellectual Property Office of Great Britain which issued in connection with corresponding British Application No. 0705144.4 on May 30, 2007.
(Continued)

*Primary Examiner* — Monica Carter
*Assistant Examiner* — Seahee Yoon
(74) *Attorney, Agent, or Firm* — Vorys, Sater, Seymour and Pease LLP; Rex W. Miller, II

(57) ABSTRACT

The present invention provides a hydro-pneumatically operated fastener installation tool (2), including a head (4) having hydraulically driven gripping and pulling means for gripping and pulling the stem of a fastener, thereby to install the fastener, and a hydraulic inlet port (6) provided in the head (4) for supplying hydraulic fluid to a cylinder (8) to drive the gripping and pulling means, wherein the cross-sectional shape of the hydraulic inlet port (6) is non-circular, such that a cross section of the inlet port (6) has a longitudinal axis and lateral axis, wherein the longitudinal axis runs widthways across the tool head (4).

19 Claims, 4 Drawing Sheets

(51) Int. Cl.

| | |
|---|---|
| ***B21J 15/22*** | (2006.01) |
| ***B21J 15/04*** | (2006.01) |
| ***B21J 15/32*** | (2006.01) |

(56) References Cited

U.S. PATENT DOCUMENTS

| | | | | |
|---|---|---|---|---|
| 5,697,137 | A | 12/1997 | Frearson et al. | |
| 6,272,899 | B1 | 8/2001 | Bentivogli | |
| 6,367,139 | B2 | 4/2002 | Wille | |
| 6,425,170 | B1 * | 7/2002 | Zirps et al. | 29/243.525 |
| 6,532,635 | B1 | 3/2003 | Gregory | |
| 6,612,557 | B2 | 9/2003 | Sawdon et al. | |
| 6,622,363 | B2 | 9/2003 | Komsta | |
| 6,886,226 | B1 | 5/2005 | Dear et al. | |
| 6,907,649 | B2 | 6/2005 | Yamada | |
| 7,082,657 | B1 | 8/2006 | Lin | |
| 7,284,404 | B2 | 10/2007 | Lin | |
| 2002/0189067 | A1 | 12/2002 | Komsta | |
| 2004/0055973 | A1 | 3/2004 | Romanyszyn et al. | |
| 2004/0112178 | A1 | 6/2004 | Gilbert et al. | |
| 2005/0109493 | A1 | 5/2005 | Wu et al. | |
| 2009/0108228 | A1 * | 4/2009 | Hall | 251/366 |

FOREIGN PATENT DOCUMENTS

| | | | |
|---|---|---|---|
| GB | 2 388 808 | A | 11/2003 |
| GB | 2388808 | | 11/2003 |
| GB | 2 436 311 | A | 9/2007 |
| GB | 2436311 | | 9/2007 |

OTHER PUBLICATIONS

Oxford Dictionary "hydraulic" <http://oxforddictionaries.com/definition/hydraulic?region=us&q=hydraulic>.

Search Report for GB Application No. 0705144.4, dated May 30, 2007.

* cited by examiner

| *For pressure 5500 PSI* | | | |
|---|---|---|---|
| **Inlet port cross-sectional shape** | **Von Mises Stress (Mpa)** | **Ultimate Tensile Strength (Mpa)** | **Factor of Safety** |
| Circular (prior art) | 437 | 460 | 1.053 |
| 2mm x 6mm slot with radiused edges, perpendicular to central axis of head cylinder | 278 | 460 | 1.655 |
| 2mm x 5mm slot with radiused edges, 12.5° to central axis of head cylinder | 274 | 460 | 1.679 |

Fig. 5

| *For pressure 6900 PSI* | | | |
|---|---|---|---|
| **Inlet port cross-sectional shape** | **Von Mises Stress (Mpa)** | **Ultimate Tensile Strength (Mpa)** | **Factor of Safety** |
| Circular (prior art) | 543 | 460 | 0.847 |
| 2mm x 6mm slot with radiused edges, perpendicular to central axis of head cylinder | 349 | 460 | 1.318 |
| 2mm x 5mm slot with radiused edges, 12.5° to central axis of head cylinder | 344 | 460 | 1.339 |

Fig. 6

FASTENER INSTALLATION TOOL

This application is a continuation in part of U.S. application Ser. No. 12/305,423 filed Feb. 3, 2009, which is a national phase filing of International Application No. PCT/GB2008/000276 filed Jan. 28, 2008, which claims priority to Great Britain Application No. 0705144.4 filed on Mar. 16, 2007, each of which is incorporated herein by reference.

BACKGROUND

This invention relates to fastener installation tools, and in particular to installation tools for installing breakstem fasteners, wherein a part of the fastener is broken off during installation.

Fastener installation tools for breakstem fasteners, such as a blind rivet or bolt, install the fastener by applying a relative pulling action to the stem of the fastener, until the stem is caused to break at a weakened or breakneck point, leaving part of the stem plugging the body of the fastener. The tool may incorporate a pneumatic or hydraulic intensifier, whereby the pulling stroke of the head is actuated when hydraulic fluid enters an inlet port provided in the forging (or casting) of the tool head. Such tools are well known, for example those available under the trade mark Genesis.

The inlet port extends into the tool head from a bore formed in the forging. Currently known tools have inlet ports which are circular in cross-section.

During the broaching of a fastener by the installation tool, the pressure within the head of the tool reaches a peak. This pressure peak consequently causes stresses in the head forging, and particularly around the hydraulic inlet port. The operational life of the head is consequentially limited, as it will eventually fail by cracking around the hydraulic inlet port. The tool is therefore rendered unusable until a replacement head has been fitted.

The value of the pressure peak within the head on broaching increases with the broach load which must be applied to install the fastener, i.e. the force which must be applied to cause the fastener stem to fracture at the breakneck point. As the type and fastening strength of fasteners has improved, the pull forces required to broach fasteners has likewise increased, increasing the stress on forged heads and reducing the life of the tools.

It is an aim of the present invention to overcome or at least mitigate the above problems.

SUMMARY OF THE INVENTION

A hydro-pneumatically operated fastener installation tool, including a head having hydraulically driven gripping and pulling means for gripping and pulling the stem of a fastener, thereby to install the fastener, and a hydraulic inlet port provided in the head for supplying hydraulic fluid to a cylinder to drive the gripping and pulling means, wherein the cross-sectional shape of the hydraulic inlet port is non-circular, such that a cross section of the inlet port has a longitudinal axis and lateral axis, wherein the longitudinal axis is greater than the lateral axis.

The longitudinal axis of the fastener installation tool may run width-ways across the tool head. The cross sectional shape of the inlet port may be an oval, irregular oval, or a longitudinal slot having at least one end fully radiused.

The central axis of the inlet port may be perpendicular to a central axis of the head cylinder, such as illustrated in FIG. 7. The tool may include a handle having an intensifier tube and the head having a bore for receiving the intensifier tube. The inlet port may be in fluid communication with both the bore and head cylinder.

The inlet port may be perpendicular or angled relative to a central axis of the head cylinder.

Also disclosed is a hydro-pneumatically operated fastener installation tool comprising a handle adapted to allow a user to grasp the tool having an intensifier tube contained therein and a head. The head has a bore for receiving said intensifier tube, an inlet port extending from the bore, and a hydraulically driven cylinder in fluid communication with the inlet port. The inlet port is in fluid communication with the intensifier tube when the tube is received in the bore. The inlet port has a non-circular cross sectional area. The hydraulically driven cylinder is for gripping and pulling the stem of a fastener thereby to install the fastener. The cross section of the inlet port has a longitudinal axis and a lateral axis.

According to other arrangements, the inlet port may have an oval shape, an irregular oval shape, or a longitudinal slot, which may be fully radiused. The inlet port may be perpendicular or angled relative to a central axis of the head cylinder and the bore.

An advantage of the present invention is that stress around the hydraulic inlet port in the tool head caused on fastener broaching is minimized. Consequently, potential deterioration of the tool head is minimized and the operating life of the head lengthened in comparison to currently known tool heads.

A further advantage is that the tool head can be compatible with known installation tools such that it is interchangeable with currently known tool heads.

Preferably the hydraulic inlet port is oval in cross-section. The inlet port may also be formed of an irregular oval, or an elongated slot, which could be fully radiused at each end.

The central axis of the inlet port may be perpendicular to the central axis of the head cylinder.

BRIEF DESCRIPTION OF THE DRAWINGS

An embodiment of the present invention will now be described by way of example and with reference to the accompanying drawings in which:

FIGS. 5 and 6 are comparison tables of maximum stresses encountered in currently known tool heads and embodiments of tool heads according to the invention, at internal tool head pressures of 37.92 MPa and 47.57 MPa respectively.

DETAILED DESCRIPTION

Figure 1:
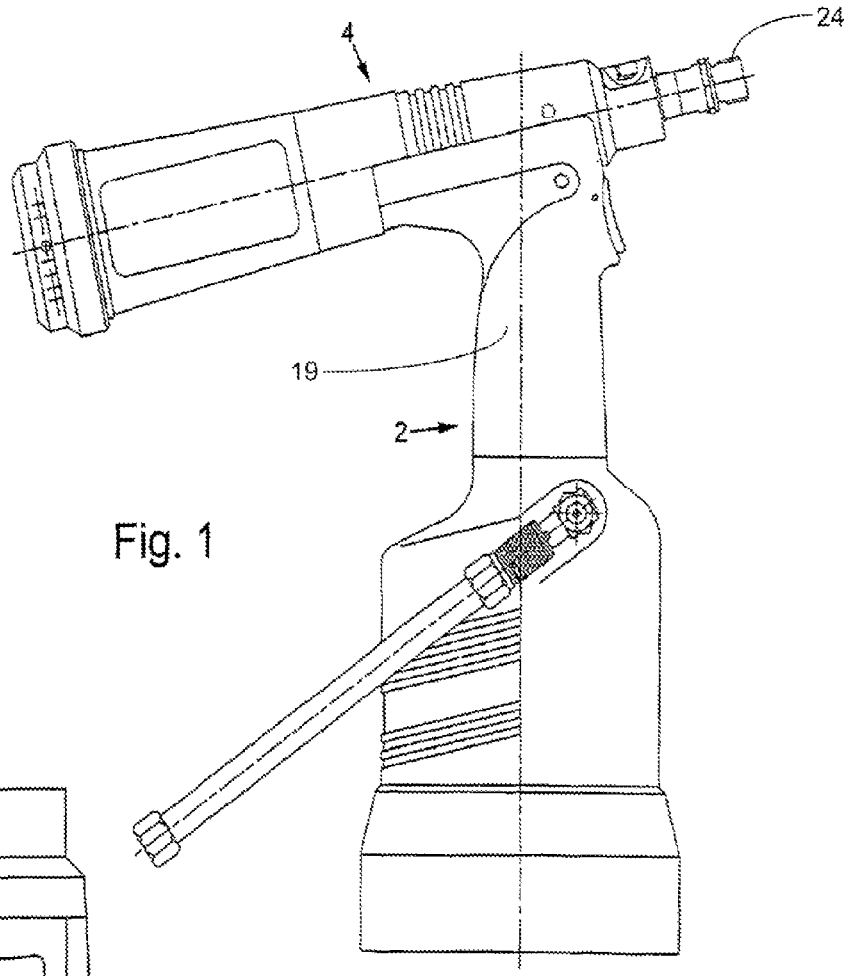
FIG. 1 is a side elevation of an installation tool in accordance with the present invention.
Figure 2:
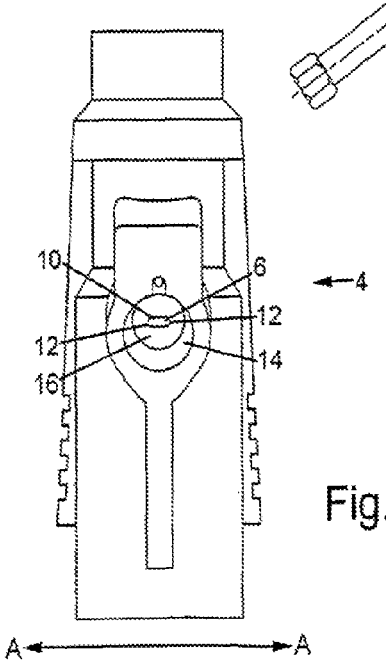
FIG. 2 is an elevation of the underside of the head of the installation tool of FIG. 1.
Figure 3:
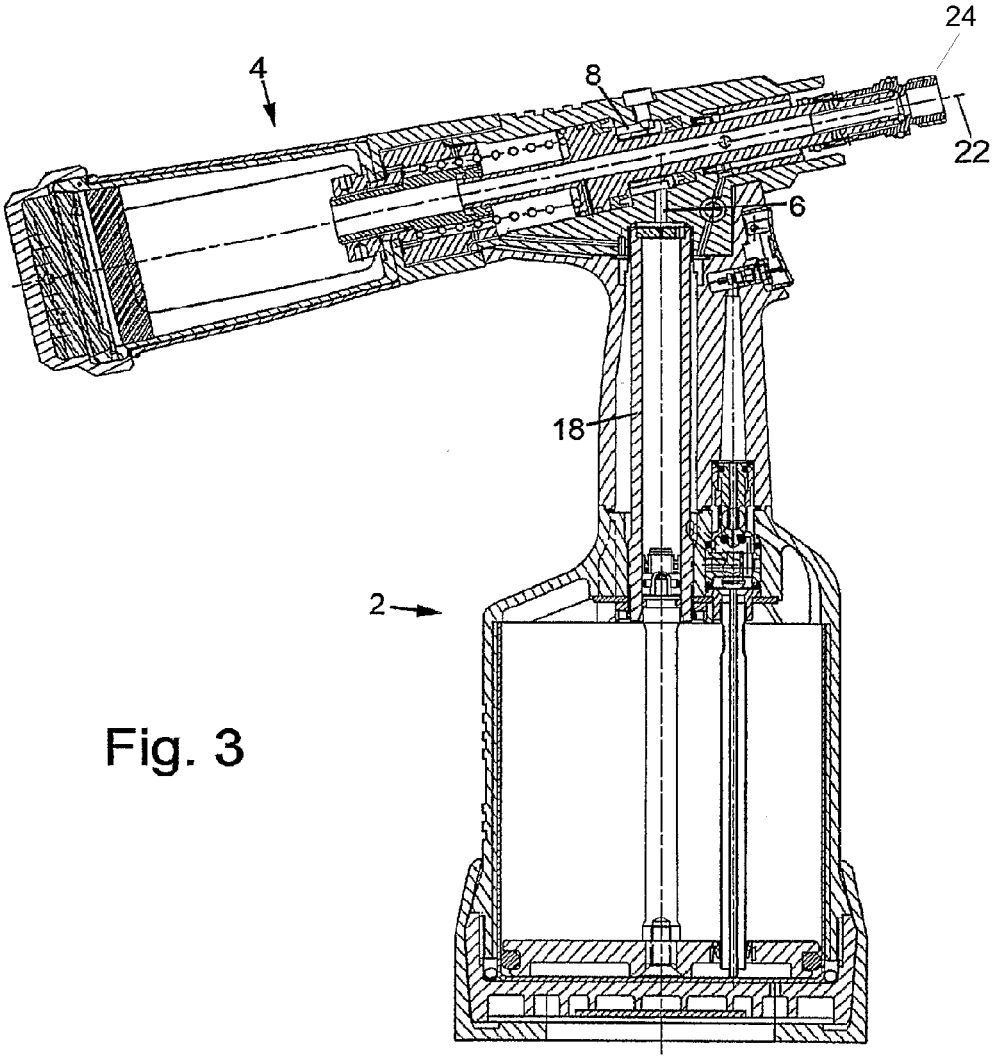
FIG. 3 is a longitudinal cross-section of the head of the installation tool of FIG. 1.

Referring to FIGS. 1 and 2, the present invention provides a hydro-pneumatically operated fastener installation tool 2 having a tool head 4 with hydraulically driven gripping and pulling means 24 for gripping and pulling the stem of a fastener thereby to install the fastener. The hydraulically driven gripping and pulling means may be a hydraulically driven nosepiece as illustrated in FIGS. 1 and 3. A hydraulic inlet port 6 is provided in the tool head 4 for supplying hydraulic fluid to a head cylinder 8 provided in the head 4 to drive the gripping and pulling means. The shape of the hydraulic inlet port is non-circular, such that a cross section of the inlet port has a longitudinal axis and lateral axis, wherein the longitudinal axis runs widthways across the tool head.

Figure 4:
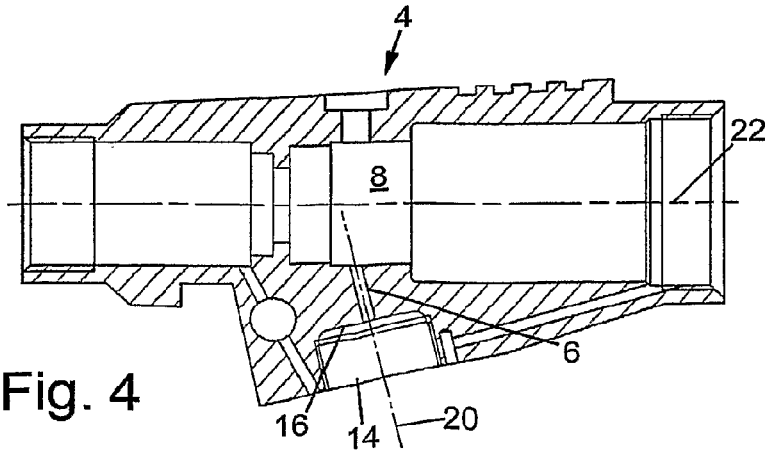
FIG. 4 is an axial cross-section of the head of the installation tool of FIG. 1.
Figure 7:
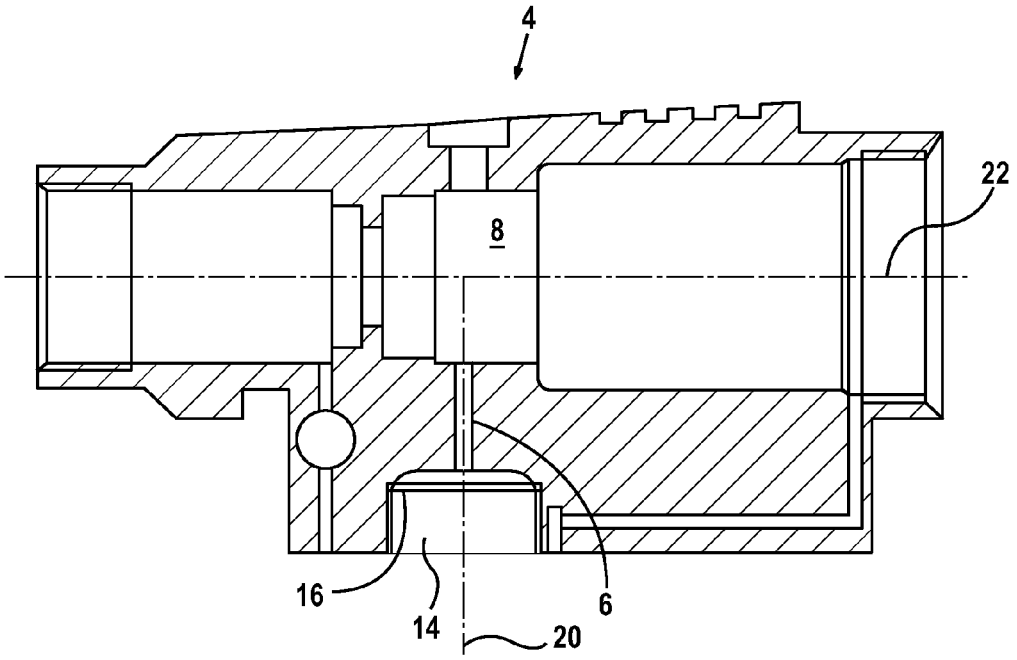
FIG. 7 is an enlarged side view of the head of the installation tool of FIG. 1.

As illustrated in FIG. 2, the inlet port 6 comprises an elongated slot 10 with a full radii at each end 12. The longitudinal axis 26 of a cross-section of the slot 10, i.e. the axis extending between the ends 12, runs widthways across the tool head 4, i.e. in the direction of arrow A on FIG. 2, and the lateral axis 28 of the cross-section runs lengthways across the tool. The inlet port 6 extends from the inner surface 16 of a bore 14 (which accepts an intensifier tube 18 (FIG. 3) when the head is attached to the tool), to the head cylinder 8. As illustrated in FIG. 4, the central axis 20 of the inlet port 6 is normal to the inner surface 16, and is therefore angled relative to the central axis 22 of the head cylinder 8. It is also contemplated that the central axis 20 of the inlet port 6 may be angled relative to the inner surface 16 of the bore 14 and may be perpendicular to the central axis 22 of the head cylinder 8. Alternatively, the bore 14 may be provided perpendicular to the central axis 22 of the head cylinder 8 and the inlet port 6 may extend perpendicular to both the inner surface 16 and to the central axis 22 of the head cylinder.

The bore 14 has a screw thread, push fastener, other type of fluid coupling adapted to accept the intensifier tube 18 of the tool 2, or the intensifier tube 18 may be press fit within the bore 14, thereby providing a sealed fluid connection between the handle 19 of the tool and head 4 and allow fluid transfer between a pressurized hydraulic fluid source and the head cylinder 8. The intensifier tube 18 preferably is contained within the handle 19 of the tool 2, but other arrangements are contemplated. When the intensifier tube 18 is coupled to the bore 14 a fluid path is provided between a hydraulic fluid source (connected to the tube 18 and opposite the bore 14) and the head cylinder 8 by means of the intensifier tube 18 and the inlet port 6.

A hydraulic fluid source, such as a shop line, pump output, or other known pressurized source may be connected to the tool 2 to provide a pressurized hydraulic fluid for installing fasteners. The source is coupled to the tool by a port or the like and pressurized hydraulic fluid is provided to the intensifier tube 18. The intensifier tube 18 is coupled to the head 2 to allow hydraulic fluid to pass from the intensifier tube 18 through the inlet port 6 to the head cylinder 8. To advance the piston rod, hydraulic fluid is conveyed from the source to the intensifier tube 18. The intensifier tube 18 provides the fluid to the inlet port 6 where it is finally conveyed to the head cylinder 8. This conveyance is by means of a pressure differential between the hydraulic source and the head cylinder 8.

During operation of the fastener installation tool a fastener is broached and the pressure of the fluid peaks during the broaching. For certain implementations, this pressure peak may be 5500-6900 psi. Repeated use of the fastener installation tool causes the pressure to spike and decrease, causing stress on the tool, particularly about the narrow inlet port 6. The repeated pressure stresses on the inlet port 6 eventually cause the material of the head 4, such as forged steel, to crack. Once the head around the inlet port has cracked the tool is unusable.

Referring to the tables of FIGS. 5 and 6, the maximum stress occurring in a metal tool head of a tool according to the present invention is lower than that which occurs in the prior art, wherein the inlet port has a circular cross-section.

As shown in FIGS. 5 and 6, in prior art devices utilizing inlet ports 6 having a circular cross section the Von Mises stress about the cross section peaks at approximately 437 MPa for pressure peaks of 5500 psi. The ultimate tensile strength of the material is approximately 460 psi, providing a small factor of safety (ultimate tensile strength/Von Mises stress) of 1.053. However, for non-circular openings according to the present invention, the peak Von Mises stresses are significantly lower, improving the factor of safety of the tool.

In various embodiments, the inlet port 6 is perpendicular or offset from perpendicular to the inner surface 16 of the bore 14. For example, the inlet port 6 could be arranged to be perpendicular to the axis of the head cylinder 8. Therefore the longitudinal axis of a cross-section of the inlet port 6 would be perpendicular to the axis of the head cylinder 8. This embodiment represents the second entry on the tables of FIGS. 5 and 6. Alternatively, the inlet port could be arranged to be offset at an angle so that the longitudinal axis of a cross-section of the inlet port is offset, for example 12.5°, from perpendicular to the axis of the head cylinder 8. This embodiment represents the third entry on the tables of FIGS. 5 and 6.

Two alternative types of non-circular openings have been tested and maximum stresses recorded in FIGS. 5 and 6.

According to the first non-circular opening, the inlet port 6 is perpendicular to the central axis of the head cylinder and has a 2 mm width and 6 mm length. The edges of the slot are radiused to reduce high-stress sharp corners. The inlet port 6 is sized so that the total cross-sectional area of the non-circular inlet port 6 is approximately equal to the total cross-sectional area of the circular prior art inlet port 6. In this arrangement, at a maximum peak pressure of 5500 psi, the Von Mises stress is 278 MPa, providing a factor of safety of 1.655 for a head material with 460 MPa ultimate tensile strength. At a maximum peak pressure of 6900 psi the Von Mises stress is 349 MPa, providing a factor of safety of 1.318 for a head material with 460 MPa ultimate tensile strength.

According to the second non-circular opening, the inlet port 6 is angled at 12.5° from perpendicular relative to the central axis of the head cylinder. The slot is provided with a width of 2 mm and a length of 5 mm and the edges of the slot have been radiused to reduce high-stress sharp corners. The inlet port 6 is sized so that the total cross-sectional area of the non-circular inlet port 6 is approximately equal to the total cross-sectional area of the circular prior art inlet port 6 and the perpendicular non-circular inlet port described above. In this arrangement, at a maximum peak pressure of 5500 psi, the Von Mises stress is 274 MPa, providing a factor of safety of 1.679 for a material with 460 MPa ultimate tensile strength. At a maximum peak pressure of 6900 psi, the Von Mises stress is 344 MPa, providing a factor of safety of 1.339 for a material with 460 MPa ultimate tensile strength.

The above analysis was conducted by means of finite element analysis where the Von Mises stress represents the maximum stress experienced about the perimeter of the inlet port for a given hydraulic fluid pressure peak. As will be appreciated, the use of a slotted input port 6 reduces the maximum stress on the tool, allowing for increased performance, durability and lifetime.

The above described invention has been described with respect to slotted input ports 6 in lieu of circular input ports 6. However, it is contemplated that various other irregular oval shapes may be utilized including ellipses, rectangular forms with corner radii, diamond forms with corner radii, egg shaped forms with larger and smaller end radii, and other irregular elongate forms comprising radii, elliptical sections and straight lines to practice the invention. In an embodiment, the input port may have an elongate cross section with at least two different elliptical sections. In another embodiment, the input port may have an elongate cross section with at least two straight line sections connected by elliptical or radiused sections. These shapes reduce total Von Mises stress at higher peak pressures and therefore may be useful in further improving over the tested slotted ports.

The effective cross-sectional area of the inlet port 6 of the present invention may be the equal to that of the circular port provided in currently known tool heads.

What is claimed is:

1. A hydro-pneumatically operated fastener installation tool, including a head having hydraulically driven gripping and pulling means for gripping and pulling the stem of a fastener, thereby to install the fastener, and a hydraulic inlet port provided in the head for supplying hydraulic fluid to a cylinder to drive the gripping and pulling means, wherein the cross-sectional shape of the hydraulic inlet port is non-circular, such that a cross section of the inlet port has a longitudinal axis and lateral axis, wherein the longitudinal axis is greater than the lateral axis.

2. The fastener installation tool as claimed in claim 1 wherein the longitudinal axis runs width-ways across the tool head.

3. The fastener installation tool as claimed in claim 2, wherein the cross-sectional shape of the inlet port is oval.

4. The fastener installation tool as claimed in claim 2, wherein the cross-sectional shape of the inlet port is an irregular oval.

5. The fastener installation tool as claimed in claim 2, wherein the cross-sectional shape of the inlet port is a longitudinal slot.

6. The fastener installation tool as claimed in claim 5, wherein at least one end of the longitudinal slot is fully radiused.

7. The fastener installation tool as claimed in claim 2, wherein a central axis of the inlet port is perpendicular to a central axis of the cylinder.

8. The fastener installation tool as claimed in claim 2 wherein the tool includes a handle having an intensifier tube.

9. The fastener installation tool as claimed in claim 8 wherein the head has a bore for receiving said intensifier tube.

10. The fastener installation tool as claimed in claim 9 wherein the inlet port is in fluid communication with the bore and the cylinder.

11. The fastener installation tool as claimed in claim 10 wherein the inlet port is perpendicular to a central axis of the cylinder.

12. The fastener installation tool as claimed in claim 10 wherein the inlet port is perpendicular to the bore.

13. A hydro-pneumatically operated fastener installation tool, the tool comprising:

a handle adapted to allow a user to grasp the tool;

an intensifier tube disposed within the handle; and a head having a hydraulically driven nosepiece configured to grip and pull the stem of a fastener;

a bore for receiving said intensifier tube;

an inlet port extending from said bore, said inlet port having a non-circular cross sectional area and being in fluid communication with said intensifier tube when said intensifier tube is received within said bore; and a hydraulically driven cylinder in fluid communication with said inlet port, the hydraulically driven cylinder operatively connected to the hydraulically driven nosepiece to drive the nosepiece thereby to install the fastener;

wherein a cross section of the inlet port has a longitudinal axis and a lateral axis.

14. The fastener installation tool of claim 13 wherein the inlet port has an oval shape.

15. The fastener installation tool of claim 13 wherein the inlet port has an irregular oval shape.

16. The fastener installation tool as claimed in claim 13, wherein the cross-sectional shape of the inlet port is a longitudinal slot.

17. The fastener installation tool as claimed in claim 16, wherein at least one end of the longitudinal slot is fully radiused.

18. The fastener installation tool as claimed in claim 13 wherein the inlet port is perpendicular to a central axis of the cylinder.

19. The fastener installation tool as claimed in claim 13 wherein the inlet port is perpendicular to the bore.

* * * * *